United States Patent [19]

Myers

[11] Patent Number: 4,778,407

[45] Date of Patent: Oct. 18, 1988

[54] ELECTRICAL CONNECTOR PLUG FOR CONDUCTORS ON CLOSELY SPACED CENTERS

[75] Inventor: Ronald W. Myers, Landisburg, Pa.

[73] Assignee: AMP Incorporated, Harrisburg, Pa.

[21] Appl. No.: 452,609

[22] Filed: Dec. 23, 1982

[51] Int. Cl.[4] ..... H01R 11/20

[52] U.S. Cl. ..... 439/443; 439/699

[58] Field of Search ..... 339/97 R, 97 P, 98, 339/99 R, 176 R, 176 M, 176 MF, 103 M

[56] References Cited

U.S. PATENT DOCUMENTS

| | | | |
|---|---|---|---|
| 2,107,751 | 2/1938 | Goff | 173/324 |
| 3,820,055 | 6/1974 | Huffnagle et al. | 339/97 P |
| 3,860,316 | 1/1975 | Hardesty | 339/103 M |
| 4,211,462 | 7/1980 | Wolfthal | 339/103 M |
| 4,262,984 | 4/1981 | Takahashi | 339/97 R |
| 4,265,504 | 5/1981 | Burns | 339/97 R |
| 4,327,958 | 5/1982 | Hughes et al. | 339/97 R |
| 4,364,622 | 12/1982 | Huntley | 339/97 R |
| 4,406,509 | 9/1983 | Jagen | 339/97 P |
| 4,464,002 | 8/1984 | Suzuki et al. | 339/99 R |

FOREIGN PATENT DOCUMENTS

| | | |
|---|---|---|
| 2854681 | 6/1980 | Fed. Rep. of Germany . |
| 2078450 | 1/1982 | United Kingdom . |

OTHER PUBLICATIONS

P. A. Burton, New British Telecom Plug, Socket, Cordage and Line Jack Units, Jan. 1982; POEEJ, vol. 74, pp. 308–313.

*Primary Examiner*—Gil Weidenfeld
*Assistant Examiner*—Paula A. Austin
*Attorney, Agent, or Firm*—Frederick W. Raring; David L. Smith

[57] ABSTRACT

Connector plug comprises an insulating housing having a conductor-receiving opening extending into its conductor receiving end and substantially to the leading end. The conductors extending into the opening are in parallel side-by-side relationship at the leading end. The contact members extend through openings in one of the housing sidewalls to the conductor-receiving openings. The contact members have plate-like portions having conductor-receiving slots by means of which contact is established. The plate-like portions of the contact members are arranged in a row with the planes of the plate-like portions extending diagonally with respect to the axes of the conductors. The contact members have external contact portions which extend to the leading end of the housing and partially across the leading end.

3 Claims, 3 Drawing Sheets

16
78
76
68
74
34
20
40
38
22
36
42
32
18
28
30
27
5
4
44

72
24

6
40'
42'

ELECTRICAL CONNECTOR PLUG FOR CONDUCTORS ON CLOSELY SPACED CENTERS

FIELD OF THE INVENTION

This invention relates to electrical connector plugs of the general type shown in U.S. Pat. No. 3,860,316 and in U.S. application Ser. No. 420,762 filed Sept. 21, 1982 now U.S. Pat. No. 4,457,575. The invention is particularly directed to the provision of improved contact members for connector plugs of the type shown in U.S. Pat. No. 3,860,316.

BACKGROUND OF THE INVENTION

U.S. Pat. No. 3,860,316 describes an electrical connector plug which is widely used in the telephone industry. The connector plug comprises an insulating housing having a conductor-receiving opening extending into its conductor receiving end and towards the leading end. The contact members are inserted into openings which extend into one of the housing sidewalls to the conductor-receiving opening. The contact members are simple flat stamped sheet metal contacts having barbs which penetrate the insulation of the conductors to establish electrical contact with the cores of the conductors. The conductors and the contact members are on relatively closely spaced centers and the contact members are arranged in a row in side-by-side parallel relationship.

U.S. application Ser. No. 420,762 filed Sept. 21, 1982. and application Ser. No. 423,486 filed Sept. 24, 1982 show connector plugs of the general type described in U.S. Pat. No. 3,860,316 and which are particularly intended for use in computers and computer-related equipment. The connector plugs of these pending applications also have flat stamped contact members which pierce the insulation of the conductors to establish electrical contact.

While the flat stamped contact members used in the connector plug of U.S. Pat. No. 3,860,316 are satisfactory for most circumstances of use, it would be desirable under some conditions to provide contact members having wire-receiving slots for establishing contact with the electrical conductors in the plug. A flat contact member having a wire-receiving slot therein has been shown to be capable of achieving an extremely stable and long lasting electrical contact with an insulated wire. In some computer applications particularly, it would be desirable to substitute insulation displacing slot type contact members for the simple insulation piercing contact members which are widely used.

The present invention is directed to the achievement of a plug having plate-like contacts therein which have wire-receiving slots and which plug can be installed on conductors on closely spaced centers.

One embodiment of the invention comprises an electrical connector of the type comprising an insulating housing having a conductor-receiving end and a conductor-receiving opening extending inwardly from the conductor-receiving end. The conductor-receiving opening is dimensioned to receive a plurality of conductors in side-by-side parallel relationship. A plurality of side-by-side contact members are provided. Each contact member has an internal contact portion for contacting one of the conductors. The contact members are partially inserted into contact-receiving openings which extend into a housing sidewall that extends, adjacent to the conductor-receiving opening and substantially parallel to side-by-side conductors positioned in the conductor-receiving opening. Th connector is particularly characterized in that each of the contact members has a sheet metal plate-like portion having an internal contact end, an external end, and side edges extending from the internal contact end to the external contact end. The internal contact portion comprises a conductor-receiving slot extending inwardly from the internal contact end. Each of the contact-receiving openings is a slot-like opening having a major axis which has a length substantially equal to the width of the plate-like portions, as measured between the side edges thereof, and a minor axis which has a length substantially equal to the thickness of the plate-like portions. The contact-receiving openings have their major axes parallel to each other and extend diagonally with respect to the axes of parallel conductors inserted into the conductor-receiving opening with the spacing between the conductor-receiving slots of adjacent contact members being less than the width of one of the contact members as measured between the side edges thereof and equal to the spacing between the axes of adjacent conductors inserted into the conductor-receiving opening.

In accordance with a further embodiment, each of the plate-like portions comprises a pair of plate members which are connected to each other by a fold extending along one of side edges and each contact member has an external contact portion on the external, end thereof for engagement with a complementary contact member in a complementary connector. The external contact portion comprises a contact arm which extends from the external contact end, the housing having recesses in the first sidewall extending from the contact-receiving openings towards the leading end of the housing, the recesses being dimensioned to receive the contact arms. In accordance with a further embodiment, the contact arm of each contact member is of a length sufficient to extend to the leading end of the housing, each contact arm having a laterally extending end portion which extends partially across the leading end after complete insertion of the contact member into the associated contact-receiving opening. The contact arm preferably has a rolled contact surface.

DESCRIPTION OF THE DRAWINGS

As shown in FIG. 1, a connector plug 2 in accordance with the invention is adapted to be coupled to a receptacle 4 which may be mounted on a circuit board 6 which is adjacent to a panel 8. The mating end of the receptacle 4 extends through an opening in the panel and has shielding thereon as shown at 9 and as described in the above identified U.S. application No. 420,762. A plug-receiving opening 10 extends into the mating end of the receptacle and receptacle contacts 12 are located in the opening and which are engaged with complementary contact members in the plug 2 which are described below.

Figure 1:
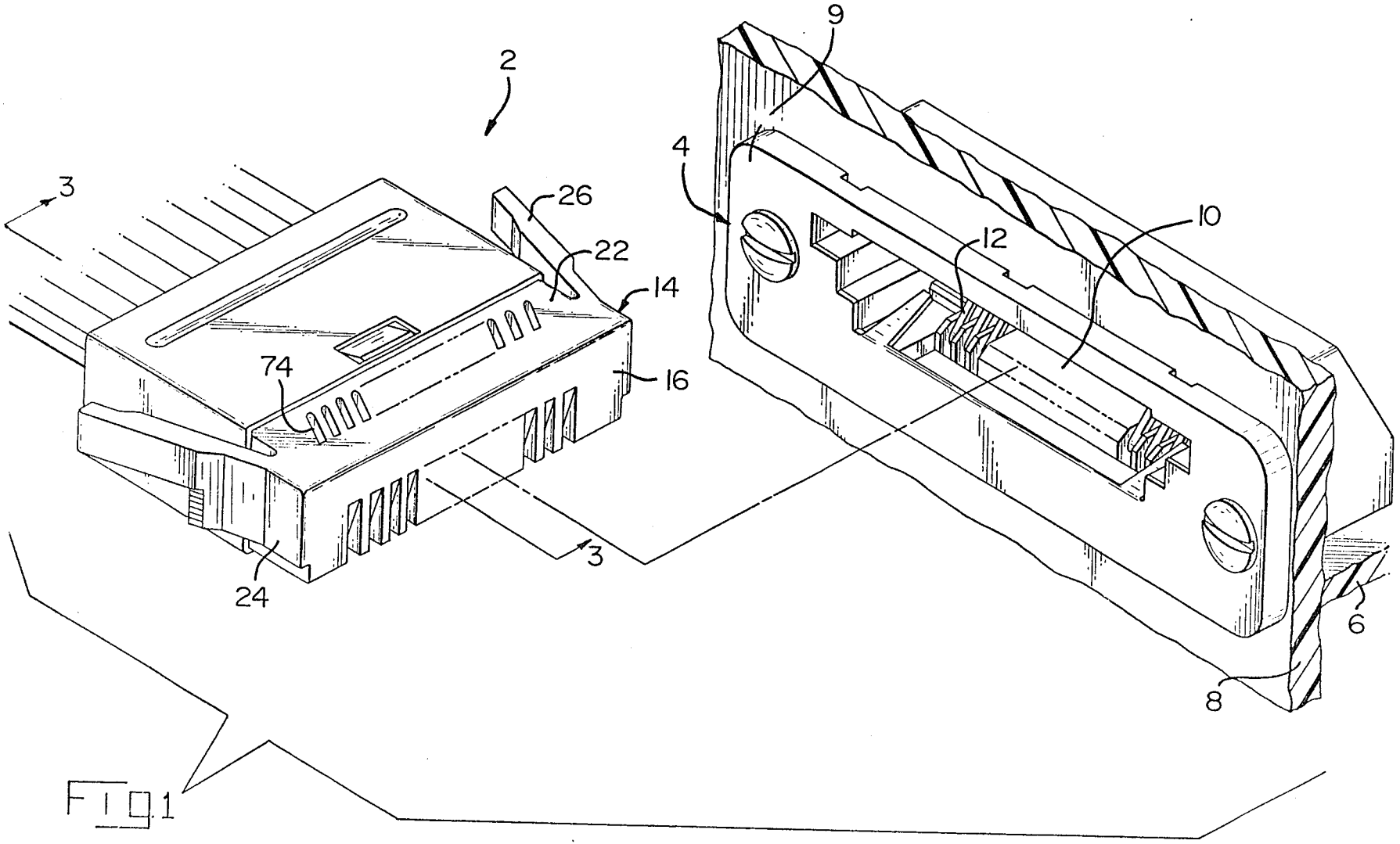
FIG. 1 is a perspective view of a connector plug in accordance with the invention and a complementary connector receptacle.

The plug 2 comprises an insulating housing 14 having a leading or mating end 16, a conductor-receiving end 18 which faces oppositely with respect to the leading end, a first or lower sidewall 20, a second or upper sidewall 22, and oppositely facing endwalls 24. Latch arms 26 extend from the endwalls and have shoulders which engage latching shoulders in the opening 10 when the plug is coupled to the receptacle.

Figures 2, 3, 4:
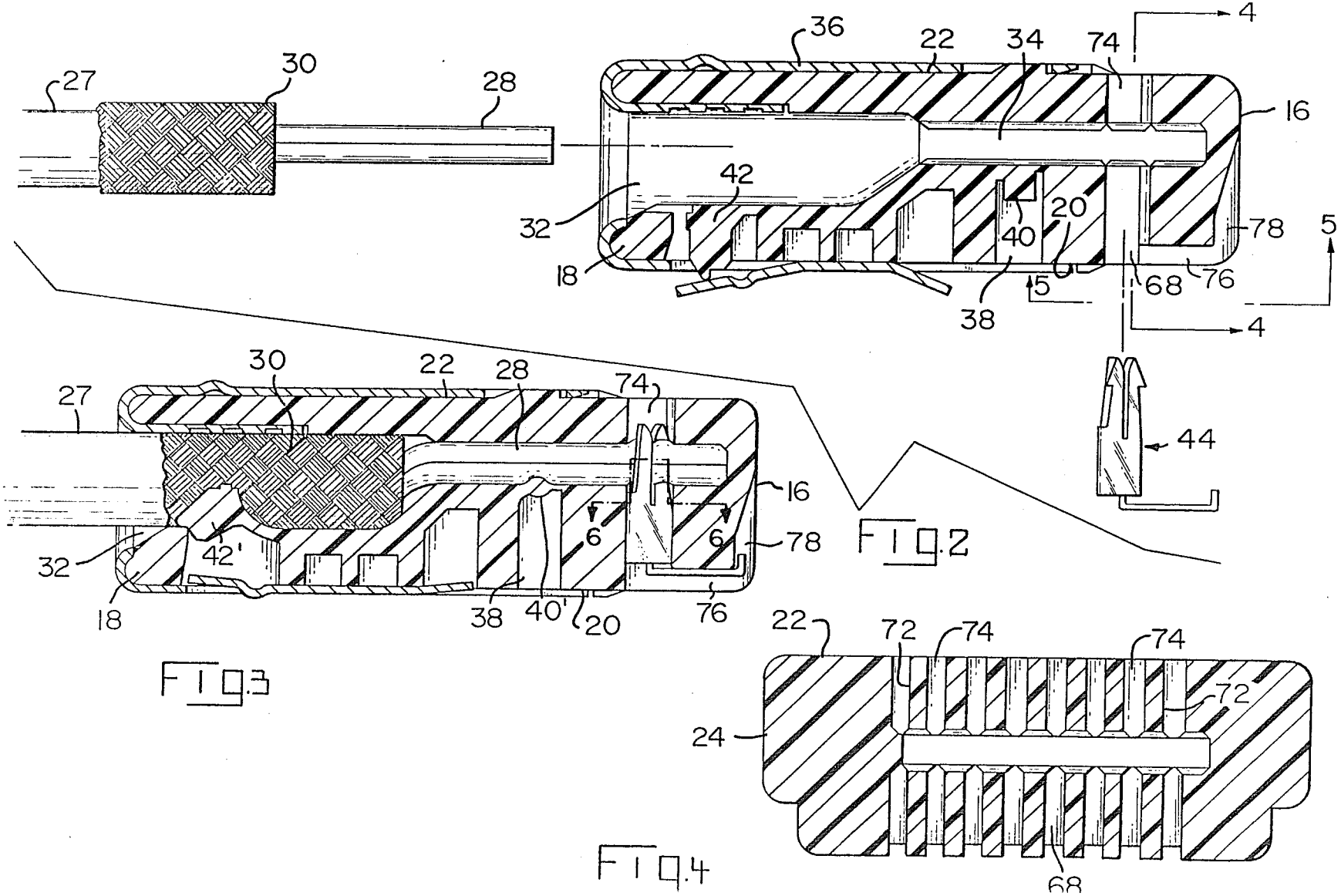
FIG. 2 is a cross-sectional view of the plug of FIG. 1 with a cable in alignment with the conductor-receiving opening in the plug and a contact member in alignment with a contact-receiving opening.
FIG. 3 is a view similar to FIG. 2 but showing the plug installed on the end of the cable, this view being taken along the lines 3—3 of FIG. 1.
FIGS. 4 and 5 are views taken along the lines 4—4 and 5—5 of FIG. 2.

A conductor-receiving opening 32 extends inwardly from the end 18 of the housing and substantially to the leading end 16. This opening receives the end portion of a cable 27 containing a plurality of conductors 28 which are surrounded by metallic shielding material 30. In FIG. 2, the shielding has been reversely turned over the cable to expose the insulated conductors 28. When the connector plug is installed on the cable, the shielding material 30 is received in the enlarged rearward portion of the opening 32 and the conductors are received in the forward portion 34 of the opening. Portion 34 is dimensioned such that the conductors 28 will be positioned in side-by-side parallel, relationship with each conductor close to, or against adjacent conductors.

The plug connector 2 has shielding 36 on its outer surface. An opening 38 in its sidewall 20 which extends to a conductor strain relief portion 40, and a cable strain relief portion 42 is provided adjacent to the conductor-receiving end 18. When the plug is installed on the cable, these strain relief portions are forced against the conductors and the cable, as shown at 40' and 42'.

Figure 6:
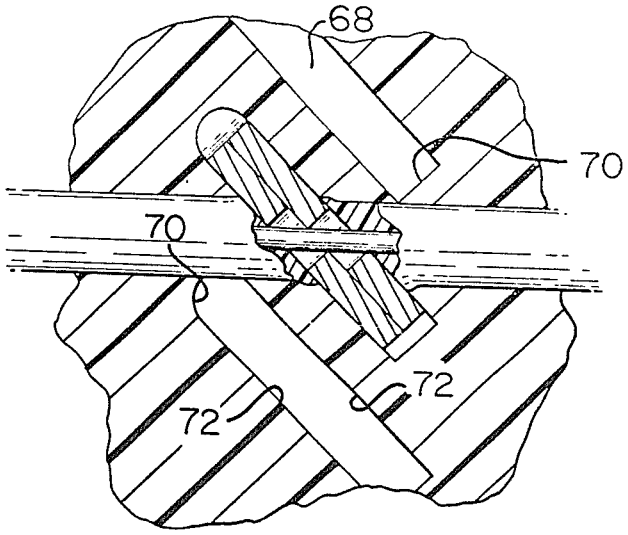
FIG. 6 is a fragmentary irregular sectional view looking in the direction of the arrows 6—6 in FIG. 3; this view shows a terminal and a wire in the centrally located opening 68 only, no terminals or wires being shown in the opening 68 on each side of the central opening.
Figure 7:
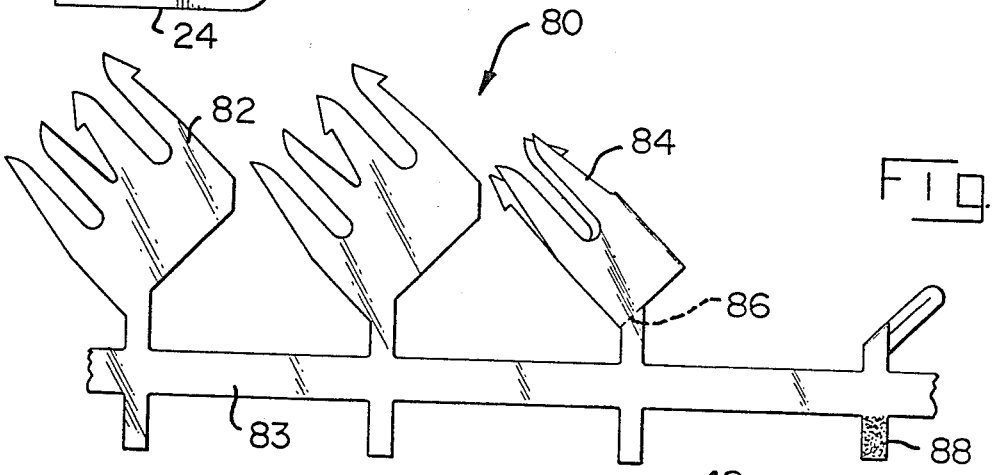
FIG. 7 is a plan view of a short section of sheet metal strip showing the manner of manufacturing contact members for the connector plug.
Figure 8:
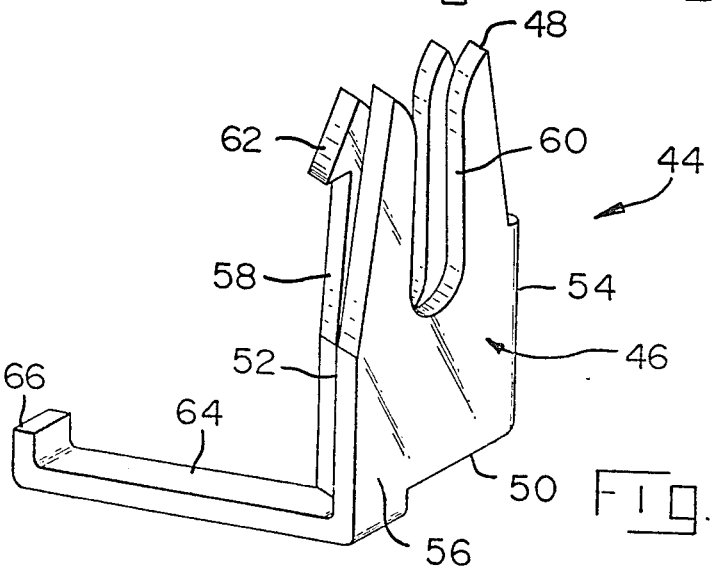
FIG. 8 is a perspective view of a contact member.

A plurality of contact members 44 are contained in the housing adjacent to the leading end 16 for establishing contact with the conducting cores of the conductors 28 and with the contact members 12 of the receptacle 4. As shown in FIG. 7, each contact member has a relatively wide plate-like portion 46 having an internal end 48 and an external end 50 which are disposed respectively within the housing and on the surface of the housing in FIG. 3. Side edges 52, 54 extend between the ends 48, 50. The contact member 44 is a stamped and formed conductive sheet metal and the plate-like portion 46 comprises two plate members 56, 58 which are joined to each other by means of a fold extending along the side edge 54. Conductor-receiving slots 60 extend inwardly from the internal ends of plate members 56, 58 and are of a width such that when a conductor 28 is forced into one of these slots, the insulation of the conductor will be displaced and contact will be established with the metallic core as shown in FIG. 6. The slots 60 of the two plate members need not necessarily be in alignment with each other so that a kink will be made in the conductor as illustrated in FIG. 6.

Barbs 62 are provided on the upper end of the plate member 58 for retaining the contact member in a contact-receiving opening 68 which is described below. The internal ends or upper ends preferably are tapered to points or edges on each side of the slots 60 to facilitate piercing of the insulation material on the conductors if the conductos have a continuous web of insulaticn as in a flat cable.

A contact arm 64 extends from the plate member 56 at the end 50 thereof, this arm extending diagonally away from the plane of the plate-like portion 46. The end of the arm is upwardly turned as shown at 66.

Figure 5:
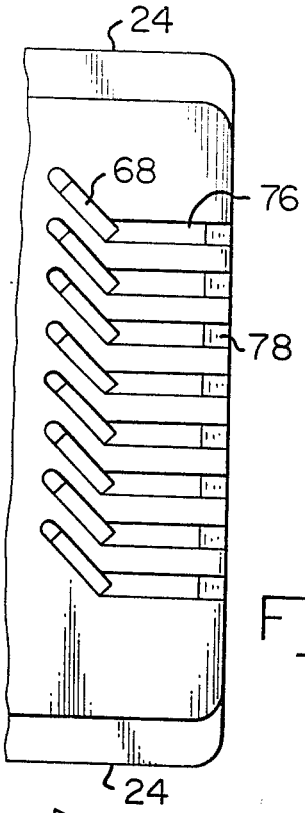

The openings 68 which receive the contact members are arranged in a row which extends between, and normally of, the endwalls 24 of the housing. Each opening has, as viewed in cross section, opposed endwalls 70 and opposed sidewalls 72. The endwalls define the major axis of the opening 72 as seen in FIG. 6 and the sidewalls 72 define the minor axis. The major axis has a length substantially equal to the width of the plate-like portion 46 of a terminal 44 as measured between the side edges 52, 54 and the minor axis has a length which is substantially equal to the thickness of the plate portion 46. In general, the openings are dimensioned to receive snuggly the plate-like portions of the terminals. The openings have their major axes arranged in prallel spaced apart planes as shown in FIG. 5 which extend normally of the axes of the conductors 28 positioned in the forward portion 34 of the opening 22. It would be apparent from FIG. 5 that when the contact members are fully inserted into the openings, the space between adjacent conductors, and therefore between the slots of adjacent contact members, is somewhat less than the width of an individual contact member as measured between the side edges 52, 54 of the contact member. The openings have upper portions 74, adjacent to the sidewall 22 which receive the internal ends of the contact members when they are fully inserted as shown in FIG. 3.

Parallel recesses 76 are provided on the housing sidewall 20 which extend from the openings 68 to the leading end 16 and which merge with parallel recesses 78 in the leading end of the housing. The recesses 76, 78 receive the contact arms 64 in the end portions 66 of these arms.

The connector plug may be supplied to a user with the contact members partially inserted into the openings 68. When the user wishes to install the connector on a cable 27, he inserts the cable into the opening 32 and fully inserts the contact members into the openings 68 until they are in the positions of FIG. 3. Alternatively, the contact members can be supplied as loose piece parts or in strip form to the user who would insert the contacts into the housing upon installation of the connector on the cable. After insertion of the contact members, the contact arms will present a contact portion or surface adjacent to the leading end 16. The contact surface may be selectively plated as shown at 88.

The contact members are preferably manufactured in strip form as shown in FIG. 7 from conductive sheet metal. The progression 80 of FIG. 7 shows a flat blank 82 extending from a central carrier strip 83. The blanks are folded as shown and then the folded contact members are bent along a bend line 86. The carrier strip can then be severed to produce the contact arm 64.

A distinct advantage of the invention is that a stable long-lived contact between the contact members and the conductors is achieved by virtue of the fact that the contact members have wire-receiving slots. The contact members must have a substantial width and the widths of contact members are accommodated by virtue of the diagonal orientation of the contact members in the housing as illustrated in FIG. 5. An additional advantage achieved is that the contact surface 88 on the arm 64 of each contact member is a flat smooth rolled surface rather than a sheared edge.

I claim:

1. An electrical plug connector of a type comprising an insulating housing having a leading end and a conductor-receiving end which faces oppositely with respect to the leading end, oppositely facing sidewall and oppositely facing endwalls extending between the leading end and the conductor-receiving end, a conductor-receiving opening extending inwardly from the conductor-receiving end, the conductor-receiving opening being dimensioned to receive a plurality of side-by-side parallel conductors disposed in a plane which is between the housing sidewalls so that the leading ends of the conductors will be located proximate to the leading end of the housing, a plurality of side-by-side contact members, each contact member having an external contact portion for containing a conductor in a complementary receptacle when the plug connector is coupled to the receptacle and having an internal contact portion for contacting one of the conductors, the contact members bieng dimensioned for insertion into contact-receiving openings which extend into a first one of the sidewalls and to the conductor-receiving opening, the openings being arranged in a row which extends normally of, and between, the endwalls, the plug connector being characterized in that:

each of the contact members has a sheet metal plate-like portion having an internal contact end, an external contact end, and side edges extending from the internal contact end to the external contact end, the internal contact portion comprising a conductor-receiving slot extending inwardly from the internal contact end, the external contact portion being on the external contact end, each of the contact-receiving openings being a slot-like opening having a major axis which has a lenght substantially equal to the width of the plate-like portions as measured between the side edges thereof and a minor axis which has a length substantially equal to the thickness of plate-like portions, the contact-receiving openings having their major axes parallel to each other and extending diagonally with respect to the axes of parallel conductors inserted into the conductor-receiving opening, the conductor-receiving slots of adjacent contact members in the openings being mutually spaced apart by an amount less than the width of one of the contact members as measured between the side edges and being equal to the spacing between the axes of adjacent conductors inserted into the conductor-receiving opening, the external contact portion of each contact member comprising a contact arm which extends form the external contact end and is bent to extend diagonally of the plane of the plate-like portion to present a rolled contact surface, the housing having recesses in the first sidewall extending from the contact-receiving openings towards the leading end of the housing, the recesses bieng dimensioned to receive the contact arms whereby upon insertion of the conductors into the conductor-receiving opening and insertion of the contact members into the contact-receiving openings, the conductors will be received in the conductor-receiving slots of the contact members and the external contact portions of the contact members will be located proximate to the first sidewall of the housing.

2. An electricla plug connector as set forth in claim 1 characterized in that each of the plate-like portions comprises a pair of plate members which are connected to each other by a fold extending along one of the side edges.

3. An electrical plug connector as set forth in claim 1 characterized in that the contact arm of each contact member is of a lenght sufficient to extend to the leading end of the housing, each contact arm having a laterally extending end portion which extends partially across the leading end after complete insertion of the contact member into the associated contact-receiving opening.

* * * * *